US006439952B1

(12) United States Patent
Yamamura

(10) Patent No.: US 6,439,952 B1
(45) Date of Patent: Aug. 27, 2002

(54) SWING POSTURE DOLL

(76) Inventor: Mitsuru Yamamura, 5-7, Sakuradani-cho, Nishinomiya-shi, Hyogo (JP), 662-0032

( * ) Notice: Subject to any disclaimer, the term of this patent is extended or adjusted under 35 U.S.C. 154(b) by 0 days.

(21) Appl. No.: 09/718,333

(22) Filed: Nov. 27, 2000

(30) Foreign Application Priority Data

Nov. 1, 2000 (JP) ..... 2000-375282

(51) Int. Cl.[7] ..... A63H 3/46

(52) U.S. Cl. ..... 446/383; 446/330; 446/268; 446/376

(58) Field of Search ..... 446/330, 333, 446/334, 335, 336, 268, 376, 379, 380, 381, 383, 384, 390; 40/411, 418, 419, 421, 424

(56) References Cited

U.S. PATENT DOCUMENTS 3,864,870 A * 2/1975 Breslow et al. ..... 446/334
4,274,224 A * 6/1981 Pugh et al. ..... 446/375
4,279,419 A * 7/1981 Barnes et al. ..... 273/108.22
4,680,019 A * 7/1987 Baerenwald et al. ..... 446/378
5,009,424 A * 4/1991 Harth et al. ..... 273/85 D
5,394,766 A * 3/1995 Johnson et al. ..... 40/414
5,413,517 A * 5/1995 Kamijima ..... 40/411
5,443,188 A * 8/1995 Kotlarsky et al. ..... 223/66
5,458,523 A * 10/1995 Aoki et al. ..... 273/440.1
5,558,555 A * 9/1996 Kennedy ..... 446/330
6,267,640 B1 * 7/2001 Akashi et al. ..... 446/376
6,280,285 B1 * 8/2001 Morehouse ..... 124/4
6,328,625 B1 * 12/2001 Lee et al. ..... 446/376

FOREIGN PATENT DOCUMENTS

JP 401025889 A * 1/1989 ..... 446/268

* cited by examiner

*Primary Examiner*—Jacob K. Ackun
*Assistant Examiner*—Faye Francis
(74) *Attorney, Agent, or Firm*—Wenderoth, Lind & Ponack, L.L.P.

(57) ABSTRACT

A swing posture doll includes a bent-forward chest member 5 on a waist member 4 supported by a pair of leg members 2, 2*a*. Right and left arm members 6, 7 are attached to shoulder portions on both sides of the chest member 5 so as to be capable of taking a slightly bent-forward posture. A head portion 9 is provided on the chest member 5, and the chest member 5 is capable of rotating about the shaft which can oscillate in the lateral direction. The right arm member 6 and the left arm member 7 attached to the chest member 5 are formed to be capable of rotating and bending in specified directions. Thus, by applying swinging movement from sports to the arm members 6, 7 while rotating the chest member 5, it is possible to represent a desirable swing.

7 Claims, 6 Drawing Sheets

SWING POSTURE DOLL

BACKGROUND OF THE INVENTION

1. Field of the Invention

The present invention relates to a swing posture doll capable of representing postures in performing swinging movement in golf.

2. Description of the Background Art

In order to improve striking techniques in golf, for example, its very important that positional relationships among each part of the body and an angle of movement at the time of swinging movement are proper. Therefore, it is necessary to acquire successive movements and positions of each part of the body at the time of swinging movement and to reproduce them at the time of actual swinging movement.

Even though theory established regarding how each part of the body should move at the time of swinging movement in golf, it is very difficult to actually move the body according to that theory. Hence, the most reliable way to master the correct swing is to learn desirable swinging movement through one's own eyes. From this view point, the inventor of the present invention has already proposed a doll capable of representing swinging movement in Japanese Examined Patent Publication JP-82 2-55066 (HEI-2 1990).

The doll described above has a structure such that a pair of arm members is oscillatably attached to a chest member. However, available range of movement of the chest member is not sufficient, and there has been found room for improvement in representing desirable swinging movement.

In view of this, a problem of the present invention is to provide a swing posture doll capable of representing desirable swinging movement by improving the structure of the chest member.

SUMMARY OF THE INVENTION

In order to solve the above-mentioned problem, the present invention provides a swing posture doll in which a bent-forward chest member is provided on a waist member supported by a pair of leg members. Right and left arm members are attached to shoulder positions on both sides of the chest member so as to be capable of taking a downwardly and slightly bent-forward posture, and a head portion is provided on the chest member.

The chest member is made to be rotatable about a shaft capable of lateral oscillation. The right arm member is composed of a right clavicle member, an upper arm, a forearm and a hand member. The right clavicle member is attached to the right shoulder of the chest member so as to be capable of rotating in the fore-and-aft direction. The upper end of the upper arm is attached to the right clavicle member by a shoulder hinge so as to be capable of rotating in the vertical direction, and the forearm is connected to the upper arm so as to be capable of bending in the vertical direction. The hand member is attached to the forearm so as to be capable of moving in the vertical and lateral directions.

The left arm member is composed of a left clavicle member, an upper arm, a forearm and a hand member. The left clavicle member is fixed to the left shoulder of the chest member. The upper and of the upper arm is attached to the left clavicle member by means of a shoulder hinge so as to be capable of revolving and rotating in the lateral direction. The forearm is connected to the upper arm so as to be capable of revolving and bending, and the hand member is attached to the forearm so as to be capable of moving in the vertical direction.

In the above configuration, the chest shaft capable of lateral oscillation of the chest member is attached to a fulcrum shaft in the fore-and-aft direction provided in the chest member at its lower end. The chest shaft is able to oscillate about the fulcrum shaft, and the head portion is rotatably attached to the upper end of the shaft projecting from the upper part of the chest member.

Furthermore, the chest member is fixed to the upper end of the support column standing on a pedestal on which the pair of leg members are to be placed. By rotating the support column with the use of a lever, the waist member will rotate two-dimensionally.

DETAILED DESCRIPTION OF THE PREFERRED EMBODIMENT

In the following, embodiments of the present invention will be described with reference to the illustrated examples.

Figure 1:
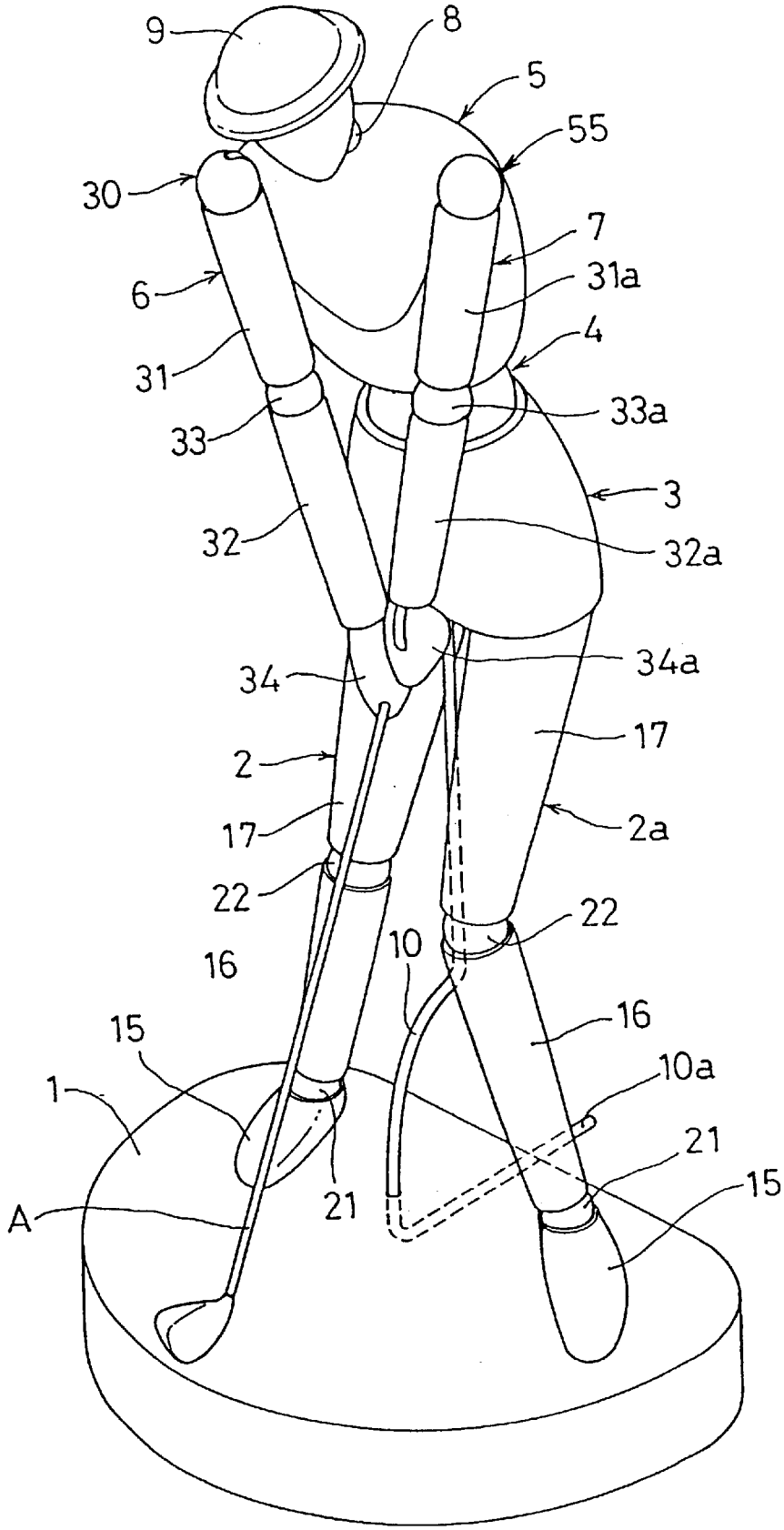
FIG. 1 is a perspective view of a swing posture doll.

As shown in FIG. 1, a swing posture doll is formed by a pair of leg members 2, 2*a* standing on a pedestal 1 having an appropriate size. A buttock member 3 is supported by upper ends of both the leg members 2, 2*a* and a spherical waist member 4 is rotatably supported on the buttock member 3. A chest member 5 is attached on the waist member 4 in a bent-forward posture so as to be capable of rotating about a shaft for allowing lateral oscillation in a bent-forward posture. Left and right arm members 6, 7 are attached to the chest member 5 at each shoulder position on each side of the upper part of the chest member 5 so as to be capable of taking a downwardly and slightly bent-forward posture, and a head portion 9 is attached to a neck member 8 on the upper end of the chest member 5.

Figure 2A:
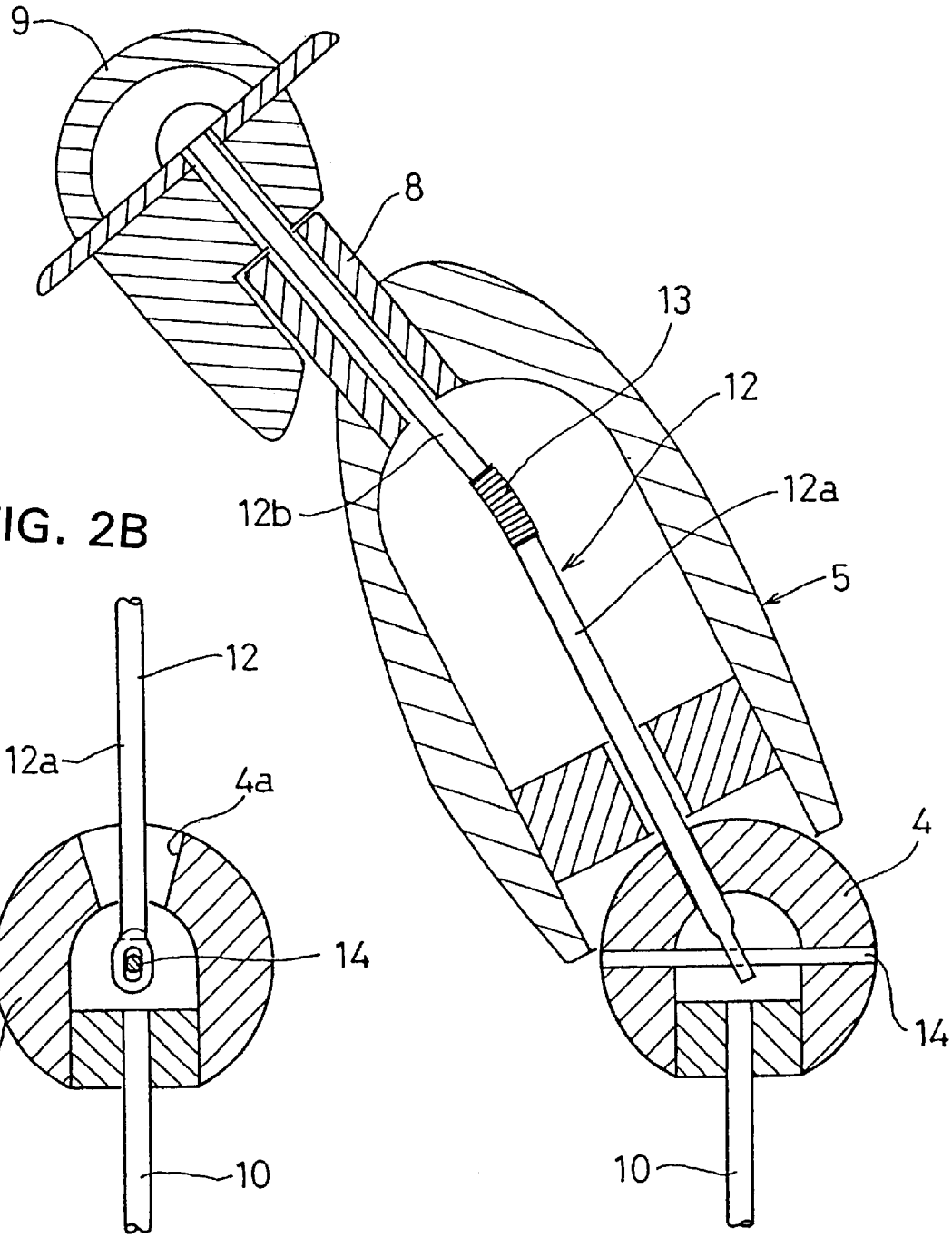
FIG. 2(A) is a side view in longitudinal section showing an upper part of the swing posture doll.
Figure 2B:
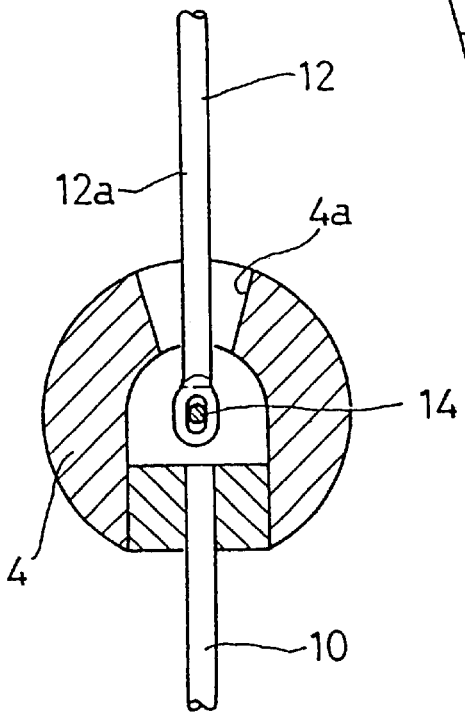
FIG. 2(B) is a front view in longitudinal section of a waist member.
Figure 3:
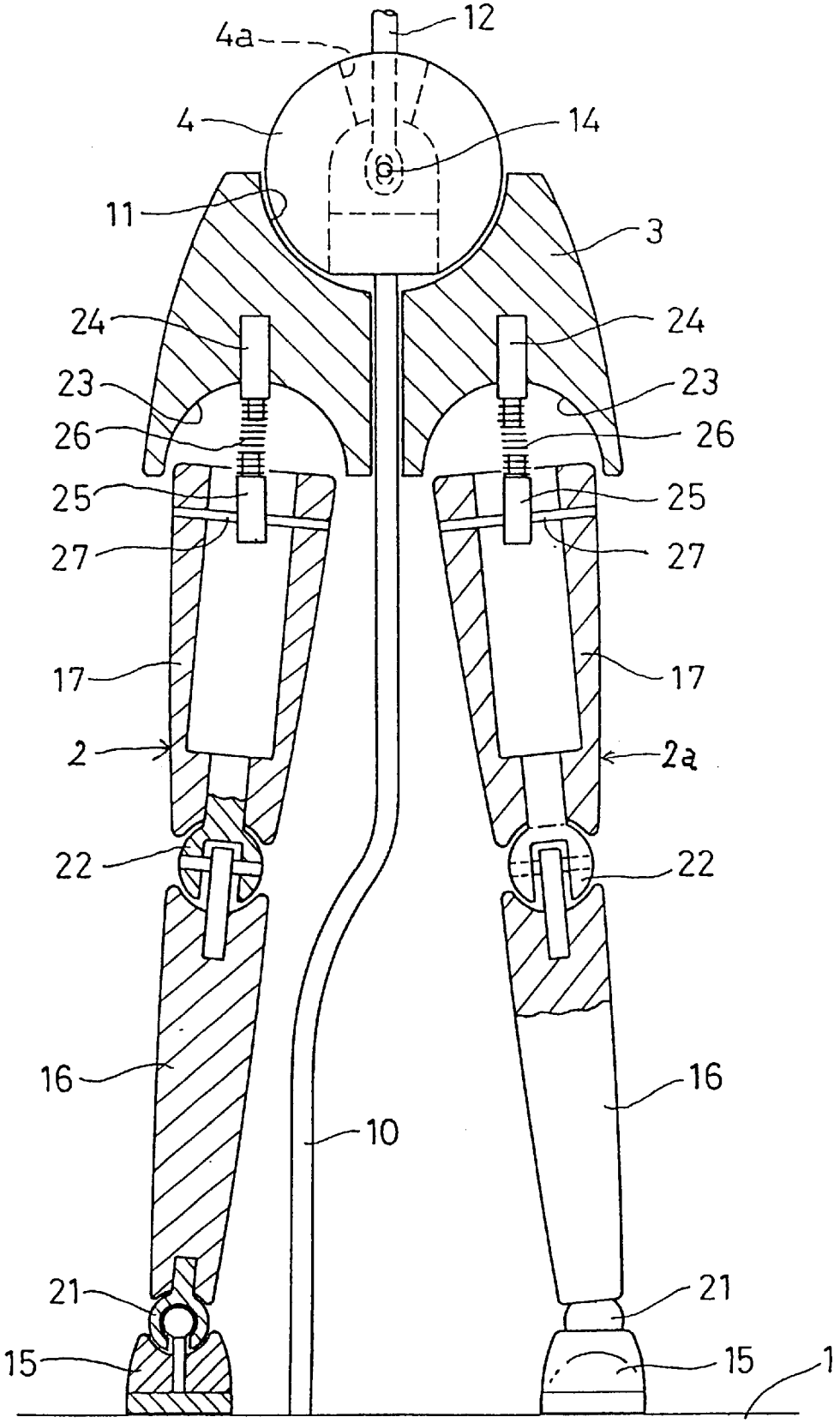
FIG. 3 is a front view in longitudinal section showing the upper part of the portion posture doll.

As shown in FIGS. 1 to 3, an upper end of a support column 10 disposed so as to stand on the upper surface of the pedestal 1 penetrates through the buttock member 3 in the in the vertical direction so that the buttock member can rotate. The lower part of the waist member 4 is rotatably fitted in an arc-shaped concave portion 11 provided in the upper part of the buttock member 3, and the waist member 4 is fixed to the upper end of the support column 10 so as to allow the support column 10 and the waist member 4 to rotate in an integrated manner.

The chest member 5 is hollow inside, as an opening in the lower part of chest member 5 fitted above the waist member 4, and has a vertical shaft 12 disposed inside the waist member 5. The shaft 12 is formed by connecting a lower shaft 12*a* in a slightly bent-forward posture and an upper shaft 12*b* in a further bent-forward posture by a flexible member 13 such as a wire, rubber, spring and the like for allowing bending. The lower end of the lower shaft 12*a* is pivoted on a fulcrum shaft 14 aligned in the for-and-aft direction and provided in the waist member 4 so as to allow oscillation in the lateral direction with the fulcrum shaft 14 being the center of oscillation. The upper shaft 12*b* rotatably penetrates through the neck member 8 at an upper end portion thereof. The neck member 8 is fixed to the upper center part of the chest member 5, and has an upper end attached to the head portion 9 in a rotatable manner so that the head portion 9 is located on the neck member 8.

As described above, the waist member 4 is able to rotate two-dimensionally. Thus, the shaft 12, which has its lower end attached to the fulcrum shaft 14 of the waist member 4, can two-dimensionally rotate integrally with the waist member 4. Accordingly, the head portion 9 attached to the shaft 12 rotates integrally with the waist member 4.

The support column 10 located on the pedestal 1 is bent at a midpoint of the lower part, and curved toward the pedestal 1 in a rotatable manner so that the lower end thereof is positioned directly under the center of the upper end portion of the right leg member 2. The lower end portion of the support column 10 is formed into a lever 10*a* projecting rearward from the pedestal 1. By causing the lever 10*a* to oscillate, thereby rotating the support column 10, the waist member 4 is caused to rotate.

Figure 5:
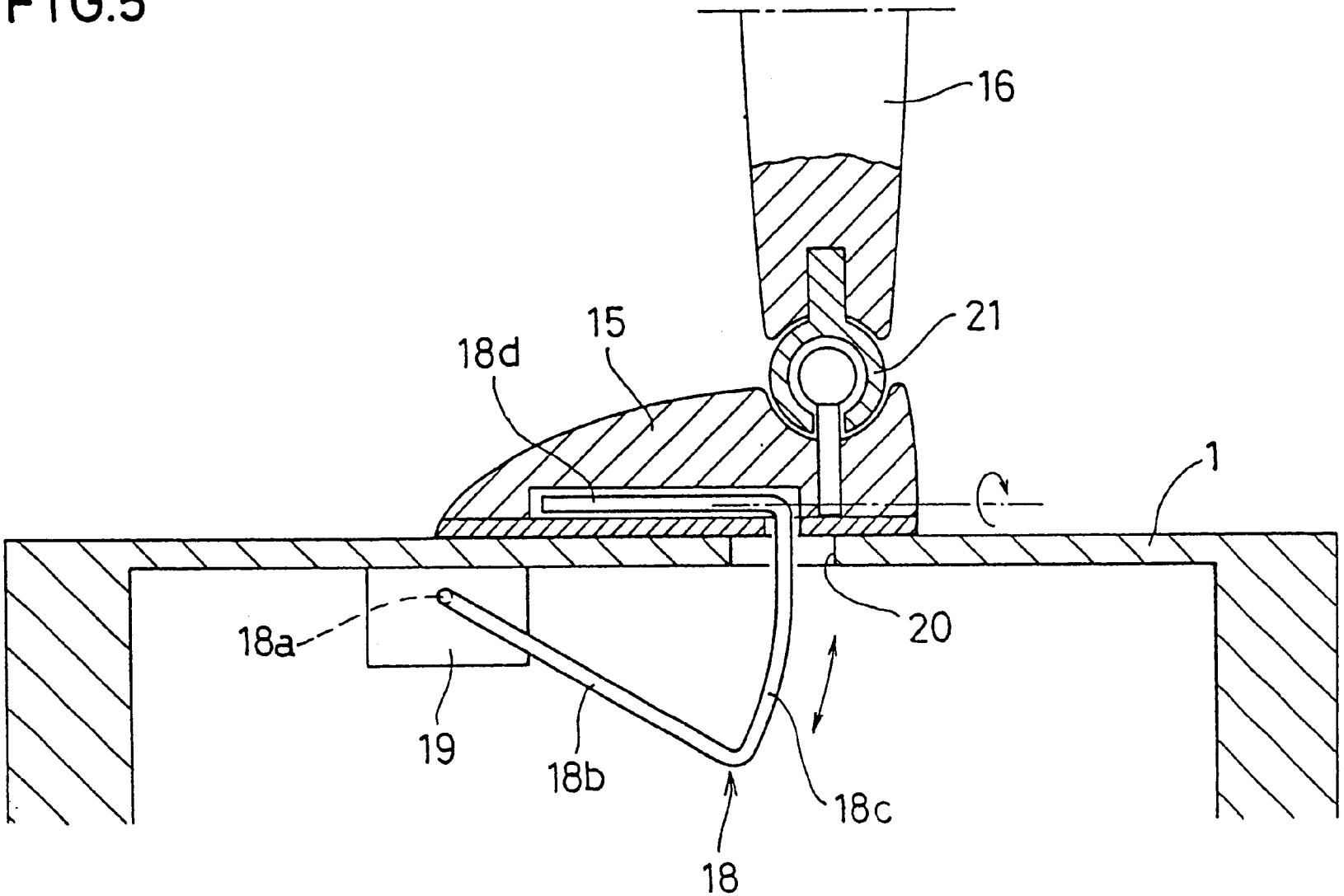
FIG. 5 is an enlarged section view showing a part where a foot member is attached to a pedestal.

The pair of leg members 2, 2*a* each consist of a combination of a foot member 15 to be attached to the pedestal 1, a lower limb 16 located above the foot member 15 and an upper limb 17 located above the lower limb 16. As shown in FIG. 5, the foot member 15 is attached to the pedestal 1 via an attachment member 18 made of wire.

The attachment member 18 is formed in such a manner that a lateral shaft 18*a* of the front end is curved toward a bearing member 19 provided in the bottom surface of the pedestal 1. At the rear end of a lower shaft 18*b* which extends rearward from one end of the lateral shaft 18*a* is provided an arc-shaped shaft 18*c* which forms an arc shape with the lateral shaft 18*a* being the center thereof. The arc-shaped shaft penetrates in the vertical direction through a hole 20 provided in the pedestal 1. At the upper end of the arc-shaped shaft 18*c* is a fulcrum shaft 18*d* bending forward, with the result that the attachment member 18 is capable of oscillating in the vertical direction with the lateral shaft 18*a* being the center of oscillation. And the foot member 15 is attached to the fulcrum shaft 18*d* so as to be capable of rotating in the lateral direction on the pedestal 1.

Accordingly, the foot member 15 can make motion combining vertical tilting motion with its toe portion being the fulcrum of tilt with respect to the fore-and-aft direction and rotating motion in the lateral direction with the fulcrum shaft 18*d* being the center of rotation. As shown in FIG. 3, the foot member 15 and the lower end of the lower limb 16 are connected by a universal joint 21 capable of accepting motion of the foot member 15, while the upper end of the lower limb 16 and the lower end of the upper limb 17 are connected by a knee joint 22 enabling bending motion.

As shown in FIG. 3, attachment of the buttock member 3 and the upper limb 17 at each of the leg members 2, 2*a* is achieved in such a manner that a concave cut portion 23 is provided on each side of the lower part of the buttock member 3. A lower shaft 25 is connected to an upper shaft 24 (fixed to the buttock member within the concave cut portion 23) by a flexible member 26 such as a wire, rubber, spring and the like to thereby enable bending. The lower end portion of the lower shaft 25 is connected to a lateral shaft 27 laid transversely in the upper end of the upper limb 17 so as to leave small play therebetween. Consequently, the buttock member 3 is supported by both the leg members 2, 2*a*.

With the configuration as described above, the pair of leg members 2, 2*a* support the waist member 4 so as to allow rotation in the horizontal direction on the buttock member 3, which stands on the pedestal 1 and is supported by both the leg members 2, 2*a* so that an angle of opening of legs and an angle of bending in the fore-and-aft direction can be set freely.

When both the leg members 2, 2*a* rotate in the condition that the lower limb 16 and the upper limb 17 slightly bend forward, they allow rotations of the lower limb 16 and the upper limb 17 by right-and-left rotation and fore-and-aft oscillation with the front end of the foot member 15 being the fulcrum.

Figure 4:
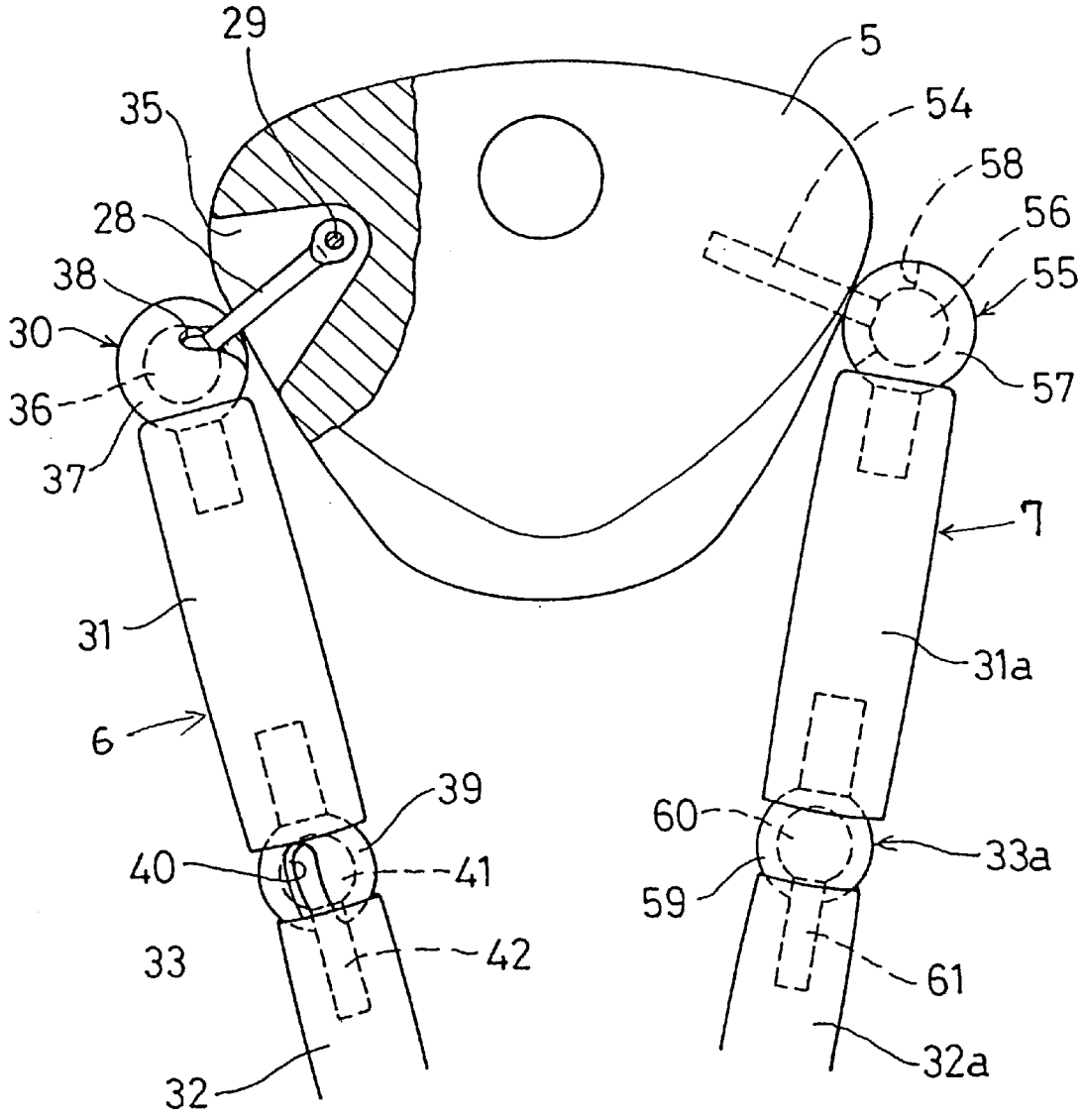
FIG. 4 is a plan view partially cut away showing a shoulder portion and an arm portion of the swing posture doll.

As shown in FIGS. 1 and 4, the right arm member 6 is attached at the position of the right shoulder of the chest member 5. A right clavicle member 28 is pivotally connected to the chest member 5 by a pin 29 so as to allow movement along the horizontal direction in the fore-and-aft direction. An upper arm 31 is attached to the front end of the right clavicle member 28 by a shoulder hinge 30 so as to allow movement along the vertical direction. A forearm 32 is connected to the front end of the upper arm 31 by an elbow hinge 33 so as to allow revolution and bending in the front, rear and vertical directions. A right hand member 34 is attached to the front end of the forearm 32 so as to allow movement along the vertical and lateral directions.

The right clavicle member 28 has a thin shaft having an inside end which is pivoted in a recess portion 35 extending in the horizontal direction provided at the right shoulder of the chest member 5 by the pin 29 so as to allow movement in the fore-and-aft direction, and an outside end to which the upper end of the upper arm 31 is attached by the shoulder hinge 30 so as to allow rotation in the vertical direction. This shoulder hinge 30 enables the upper arm 31 to rotate with respect to the right clavicle member 28 within the range of a hole portion 38 by accommodating a spherical member 36 fixed to the outside end of the right clavicle member 28 inside a hollow spherical member 37 fixed to the upper end of the upper arm 31 and providing the vertical hole portion 38 through which the right clavicle member 28 is to penetrate on the side of the hollow spherical member 37.

As shown in FIG. 4, the elbow hinge 33 connecting the upper arm 31 and the forearm 32 is formed by providing a hollow spherical member 39 fixed to the front end of the upper arm 31 with a slot 40 extending in the up-and-down (vertical) direction and accommodating a spherical member 41 in the hollow spherical member 40 in a rotatable manner. The upper end of the forearm 32 is attached to a projecting shaft 42 of the spherical member 41, whereby the forearm 32 is connected to the upper arm 31 so as to be capable of rotating and bending in the forward, backward and vertical directions within the range of the slot 40.

Figure 6B:
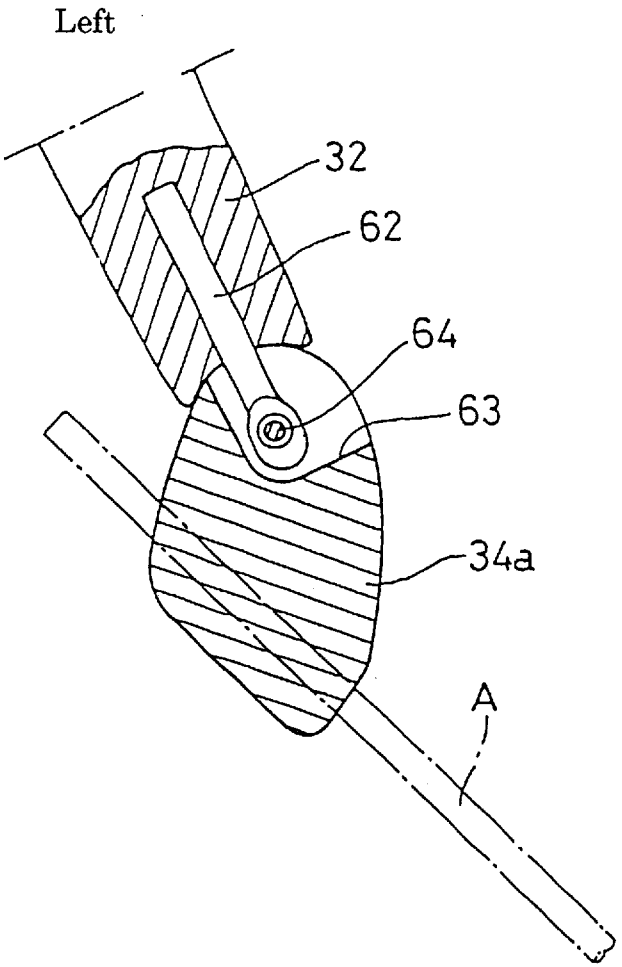
FIG. 6(B) is a section view showing attachment stucture between a forearm and a hand member of a left arm.
Figure 6A:
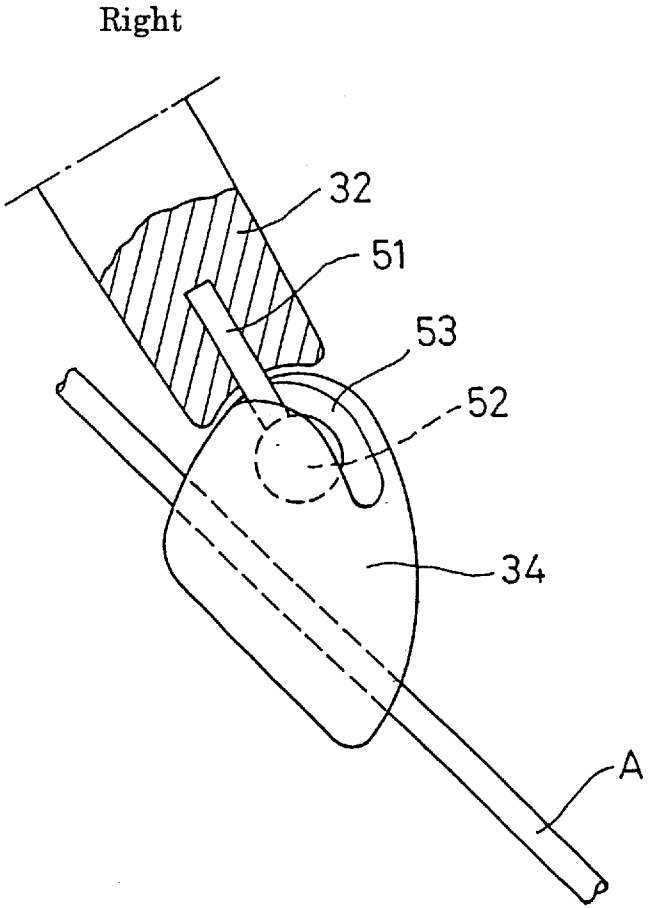
FIG. 6(A) is a section view showing attachment structure between a forearm and a hand member of a right arm.

Next, as shown in FIG. 6(A), attachment of the right hand member 34 to the forearm 20 is so configured that a spherical member 52 is provided at the front end of a hinge shaft 51 which is fixed to the forearm 32 so as to project from the front end of the forearm 32. A tilt groove 53 through which the hinge shaft 51 is to penetrate is provided at the rear part of the hand member 34 holding the spherical member 52, so that the hand member 34 is capable of bending in the diagonal direction combining the vertical and lateral direction along the tilt groove 53 with the spherical member 52 being the center of bending.

The left arm member 7 is attached at the position of the left shoulder of the chest member 5. A left clavicle member 54 is fixed to the chest member 5, and an upper arm 31*a* is attached to the front end of the left clavicle member 54 by a left shoulder hinge 55 so as to allow rotation along the lateral direction. A forearm 32*a* is connected to the front end of the upper arm 3 la by an elbow hinge 33*a* so as to allow bending in the forward, backward and vertical directions. A left hand member 34*a* is attached to the front end of the forearm 32*a* so as to allow bending in the vertical direction.

The left clavicle member 54 has a thin shaft and is fixed to the left shoulder portion of the chest member 5 so as to project to the outside. As shown in FIG. 4, the left shoulder hinge 55 enables the upper arm 31 a to revolve and rotate in the lateral direction with respect to the left clavicle member 54 within the range of a slot 58 by accommodating a spherical member 56 fixed to the outside end of the left clavicle member 54 inside a hollow spherical member 57 fixed to the upper end of the upper arm 31*a*, and by providing the slot 58 extending in the diagonally lateral direction through which the left clavicle member 54 is to penetrate on the side of the hollow spherical member 57.

The elbow hinge 33*a* connecting the upper arm 31*a* and the forearm 32*a* is formed by rotatably accommodating a spherical member 60 in a hollow spherical member 59 fixed to the front end of the upper arm 31*a*. The upper end of the forearm 32*a* is attached to a projecting shaft 61 of the spherical member 60, whereby the forearm 32*a* is connected so as to be capable of rotating and bending within a predetermined range of angle.

Furthermore, as shown in FIG. 6(B), attachment of the left hand member 34*a* with respect to the forearm 32*a* is achieved by fixing a hinge shaft 62 to the forearm 32*a* so as to project from the front end thereof. A vertical groove 63 provided in the rear part of the left hand member 34*a* is fitted on the hinge shaft 62, so that the hinge shaft 62 and the left hand member 34*a* are connected by a transverse pin 64. The left hand member 34*a* can only bend in the up-and-down direction along the vertical groove 63 with the transverse pin 64 being the center of bending.

Both the arm members 6 and 7 take a downward and slightly bent-forward posture by adjusting so that the hand member 34 of the right arm member 6 is positioned on the front side of the left hand member 34*a* of the left arm member 7 in front of the chest member 5. A golf club A is attached to both the hand members 34, 34*a* in a bent-forward and downward arrangement.

The swing posture doll according to the present invention is configured as described above. As shown in FIG. 1, by making the swing posture doll stand on the pedestal 1 so that the leg members 2, 2*a* on both sides bend slightly forwardly in the condition that the distance between them increases in the downward direction, turning the buttock member 3 and the chest member 5 to the front, stretching both the arm members 6 and 7 in a bent-forward and downward direction, and attaching the golf club A to the left and right hand members 34, 34*a* overlapping back and forth, it is possible to naturally represent the posture of address where the golf club A is held in a bent-forward posture.

Starting from this state, after taking the golf club A back along the track in the direction of track up to the top position and then swinging down, the chest member 5 is integrally rotated in the same direction. In addition, each join part operates as if a person performed down swinging after taking the club back.

In other words, when the chest member 5 rotates about the bent-forward shaft, since the shaft 12 is allowed to oscillate in the lateral direction, rotation of the chest member 5 becomes smooth. The upper arm 31 of the right arm member 6 is allowed to oscillate in the fore-and-aft direction with respect to the chest member 5 and to rotate along the hole portion 38. The chest member 5 rotates about the forwardly inclined upper shaft 12*a* in the rotation direction of the right arm member 6. The forearm 32 is bent at an approximately right angle with respect to the upper arm 31 until top is achieved when the club is taken back, and the upper arm 31 and the forearm 32 are aligned approximately in line from top to impact.

On the other side, the upper arm 31 a of the left arm member 7 can freely rotate along the slot 59 extending diagonally with respect to the chest member 5. The upper arm 31*a* and the forearm 32*a* are couple-driven in the rotation direction of the right arm member 6 so that they are slightly bent from the approximately line alignment during the period from address to top and return to the state that the upper arm 31*a* and the forearm 32*a* are slightly bent to the state that they are aligned approximately in line during the period from top to impact.

As described above, by restricting motion in the stretching direction of both the arm members 6 and 7, undesired motion does not occur at each joint portion. Thus, it is possible to represent the most theoretical swing movement, and motions of the arms and the body at the time of golf swing can be learned by viewing these representations.

Moreover, since the waist member 4 is fixed to the upper end of the support column 10, the waist member 4 is rotated by rotating the support column 10 with the lever 10*a*, and the waist member 4 and the head portion 9 are integrally rotated via the shaft 12. Thus, operation of swinging the waist can be obtained by the rotation of the support column 10.

Incidentally, in the drawings, swinging movements in golf are described. However, by attaching a bat to the right and left hand members 34, 34*a*, it is possible to make it a posture doll for baseball, and such a doll is suited for appreciation as a figurine representing a swing posture.

As described above, according to the present invention, a swing posture doll has a bent-forward chest member provided on a waist member supported by a pair of leg members, right and left arm members attached to shoulder portions on both sides of the chest member so as to be capable of taking a slightly bent-forward posture, and a head portion provided on the chest member. Therefore, the chest member becomes capable of rotating about the shaft which can oscillate in the lateral direction, and the right arm member and the left arm member attached to the chest member are formed to be capable of rotating and bending in specified directions. Consequently, the bent-forward chest member can rotate smoothly, both the arm members perform only motions required for swinging movement, a posture at the time of swinging movement can be represented in agreement with the movement of thejoint desired by a person, and proper swinging movement of various sports can be learned through watching this movement.

Furthermore, since postures of swinging movement of various sports can be realistically represented, depending on combination of the sport tool to be attached to the arm members, it may be appreciated as a figurine.

What is claimed is:

1. A swing-posture doll comprising:

a waist member including a fulcrum shaft arranged in a front-to-rear direction with respect to the doll;

a chest member including a longitudinal main shaft having a lower end connected to said fulcrum shaft of said waist member, said chest member being arranged so as to be rotatable about said main shaft and so as to be laterally pivotable about said fulcrum shaft of said waist member in a substantially vertical plane;

a pair of leg members supporting said waist member;

a right arm member including a right clavicle member, a right upper arm, a right forearm, and a right hand, said right clavicle member being connected to a right shoulder portion of said chest member so as to be laterally pivotable in a substantially horizontal plane, an upper end of said right upper arm being connected to said right clavicle member by a shoulder hinge so as to be pivotable in a substantially vertical plane, said right forearm being connected to said right upper arm so as to be pivotable in a substantially vertical plane, said right hand being connected to said right forearm so as to be pivotable in a substantially vertical plane and so as to be rotatable about a central axis of said right hand; and a left arm member including a left clavicle member, a left upper arm, a left forearm, and a left hand, said left clavicle member being fixed to a left shoulder portion of said chest member, an upper end of said left upper arm being connected to-said left clavicle member by a shoulder hinge so as to be pivotable in a substantially vertical plane and so as to laterally pivotable in a substantially horizontal plane, said left forearm being connected to said left upper arm so as to be pivotable in a substantially vertical plane and rotatable about a central axis of said left forearm, said left hand being connected to said left forearm so as to be pivotable in a substantially vertical plane.

2. The doll of claim 1, wherein said fulcrum shaft is arranged in said waist member as to be substantially transverse to a longitudinal direction of the swing-posture doll.

3. The doll of claim 1, further comprising a support column extending in a vertical direction and having an upper end connected to said waist member.

4. The doll of claim 3, further comprising a platform for supporting said pair of leg members, said support column extending downward through said platform and being bent in a rearward direction so as to form a lever, said lever being operable to be pivoted in a horizontal plane so as to rotate said waist member.

5. The doll of claim 1 wherein said main shaft comprises an upper shaft having a lower end flexibly connected to an upper end of a lower shaft by a flexible member.

6. The doll of claim 1, wherein said main shaft is connected to said fulcrum shaft such that said chest member is angled forward with respect to a longitudinal axis of said pair of leg members.

7. The doll of claim 1, further comprising a head portion connected to said chest member so as to be rotatable about a central axis of said head portion.

* * * * *